United States Patent [19]

Benasutti

[11] 4,026,627

[45] May 31, 1977

[54] ELECTRICAL CONTACT AND CONNECTOR

[75] Inventor: John Eugene Benasutti, Warren, Pa.

[73] Assignee: GTE Sylvania Incorporated, Stamford, Conn.

[22] Filed: June 23, 1976

[21] Appl. No.: 698,832

[52] U.S. Cl. ..... 339/278 C
[51] Int. Cl.² ..... H01R 13/02
[58] Field of Search ..... 339/176, 278

[56] References Cited

UNITED STATES PATENTS

| | | | |
|---|---|---|---|
| 3,173,737 | 3/1965 | Kinkard et al. | 339/176 MP |
| 3,585,573 | 6/1971 | Robshaw | 339/278 C |
| 3,858,957 | 1/1975 | Harwood et al. | 339/176 MP |

*Primary Examiner*—Joseph H. McGlynn

*Attorney, Agent, or Firm*—Norman J. O'Malley; Lawrence R. Fraley; Donald R. Castle

[57] ABSTRACT

An improved electrical contact including an angular engagement arm for slidably engaging a conductive surface, said arm including a noble metal segment thereon for electrically contacting said surface and means for preventing transfer of material from the arm onto the noble segment. The improvement resides within the material transfer prevention means wherein said means comprises at least one elongated blade having at least one edge thereon, said blade formed so that only the edge slidably engages the conductive surface prior to said noble metal segment contacting said surface. The contact is ideally suited for use within a printed circuit board connector, said connector also disclosed.

10 Claims, 11 Drawing Figures

ELECTRICAL CONTACT AND CONNECTOR

BACKGROUND OF THE INVENTION

The invention relates to electrical contacts and more particularly to contacts adapted for slidably electrically contacting a conductive surface.

The invention further relates to contacts of the nature described wherein said contacts include means for preventing transfer of material from the contact's engagement arm onto a noble metal segment positioned on said arm, said segment provided to enhance the electrical connection between the contact and the conductive surface.

The invention still further relates to contacts of the above variety wherein said contacts are adapted for use within a printed circuit board connector.

An inherent disadvantage of electrical contacts which slidably contact a conductive surface and which include thereon a noble metal segment is the inability of such members to prevent transfer of the contact's material into the segment during said sliding engagement. The transfer of the arm's material adversely affects the electrical conductive properties of the noble metal segment due to the formation of a film or similar layer of the lesser conductive material thereon.

Previous techniques to prevent material transfer, as indicated in U.S. Pat. No. 3,585,573, have included providing the upper portion of the arm with a plurality of indentations, holes, or projections which aligned on the arm above the noble segment. While these techniques may have somewhat reduced the arm material transfer onto the noble metal segment or button, several disadvantages were inherent. Providing these features on or within the contact's arm necessitated at least one additional manufacturing step, thus adding not only to the time required to manufacture the contacts but also to the cost thereof. Furthermore, the added material used in such features as projections was itself capable of "wiping" onto the noble button. Even further, these projections also proved capable of defacing the respective conductive surface to which electrical contact was made.

It is believed therefore that an improved electrical contact which includes means for preventing material transfer onto the contact's noble metal segment in a more advantageous manner than the above known components would constitute an advancement in the art.

It is further believed that a printed circuit board connector incorporating the above contact would also constitute and advancement in the art.

OBJECTS AND SUMMARY OF THE INVENTION

It is therefore a primary object of the invention to enhance the electrical contact art by providing an improved contact which prevents the transfer of material onto the contact's noble metal segment in a more advantageous manner than contacts known in the art.

It is another object of the invention to enhance the printed circuit board connector art by providing a connector which incorporates the above contact.

In accordance with one aspect of the invention there is provided an improved contact for slidably contacting a conductive surface, said contact including an angular engagement arm having a noble metal segment thereon and means for preventing transfer of the arm's material onto sid noble segment. The transfer prevention means comprises at least one blade of substantially uniform thickness and having at least one edge thereon, said blade formed so that only the edge slidably engages the conductive surface prior to electrical contact between the contact's noble metal segment and said surface.

In accordance with another embodiment of the invention there is provided an improved printed circuit board connector which includes the aforementioned contact.

DETAILED DESCRIPTION OF THE PREFERRED EMBODIMENTS

For a better understanding of the prevent invention, together with other and further objects, advantages and capabilities thereof, reference is made to the following disclosure and appended claims in connection with the above-described drawings.

Figure 1:
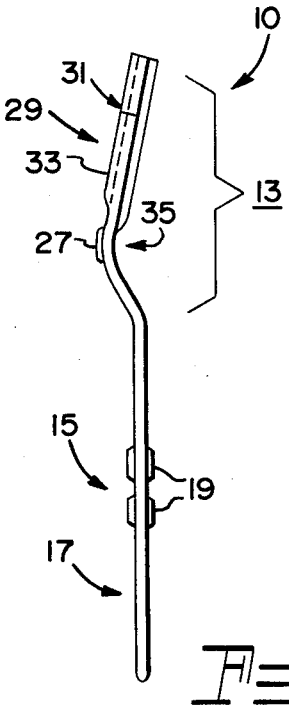
FIG. 1 is a side view of an electrical contact in accordance with a preferred embodiment of the invention.
Figure 2:
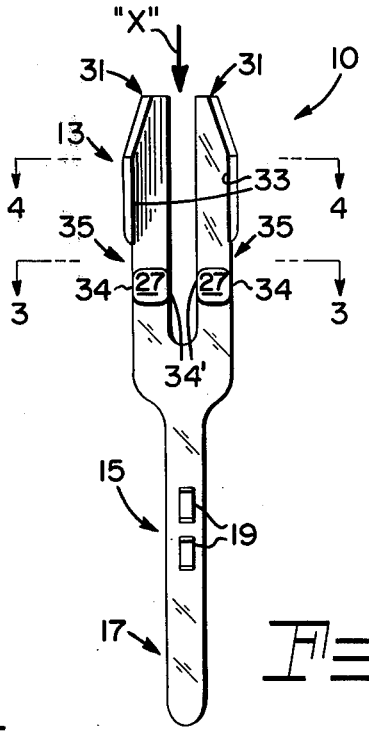
FIG. 2 is a front view of the contact of FIG. 1.
Figure 10:
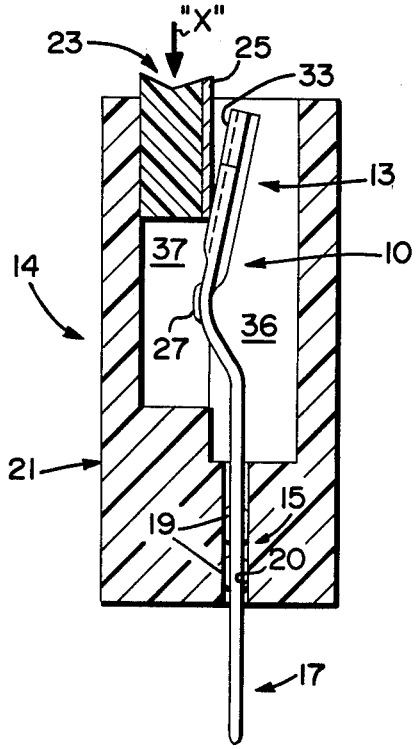
FIGS. 10 and 11 illustrate a printed circuit board connector, one of the preferred uses for the contact of the invention.

With particular reference to the drawings, there is shown in FIGS. 1 and 2 an electrical contact 10 in accordance with a preferred embodiment of the invention. Contact 10 comprises an angular engagement arm 13 which is adapted for slidably engaging a conductive surface such as that on another electrical contact or those typically provided on a printed circuit board. As will be described, a preferred use for contact 10 is in a printed circuit board connector 14 (FIG. 10). Should contact 10 be used in said manner, it is preferred that the contact further comprise a central retention portion 15 and a tail 17. Accordingly, retention portion 15 includes a plurality of protruding members 19 which frictionally engage the interior walls of an opening 20 within the connector's insulative housing. Mechanical lock means could be utilized rather than members 19 to mechanically secure contact 10 within said housing. Contact 10 may also be molded or twisted within the insulative housing, thus eliminating the need for retention portion 15. The described means of retention is preferred, however, to facilitate contact repair and replacement. Tail 17 extends from housing 21 and is adapted for having an external connective means, e.g. electrical wire, secured thereto. Connector 14 is illustrated in FIG. 10 as receiving a printed circuit board 23 having a conductive surface 25 thereon.

Contacts of the variety described above are typically electroplated with tin or similar metallic material possessing a relatively low electrical conductivity. Accordingly, the transfer of this material onto a noble metal segment 27 employed on arm 13 adversely affects the conductive capabilities of segment 27. Such transfer is normally the result of the wiping of sliding engagement between the contact's angular arm 13 and the designated conductive surface, e.g. surface 25, to which electrical contact is made. It is understood that the primary function of providing the novle segment 27 is to enhance this electrical connection. Accordingly, segment 27 is preferably comprised of the aforementioned noble metal, e.g. gold, silver, or alloys thereof, said metals well known in the art as possessing relatively high electrical conductive properties.

The contact of the present invention overcomes the aforementioned deleterious transfer by providing means 29 for preventing said transfer. Means 29 is shown in FIG. 1 as comprising at least one elongated blade 31 adjoining segment 27 on angular arm 13 and including at least one edge 33 thereon. Blade 31 is formed so that only edge 33 slidably engages the printed circuit board 23 prior to electrical contact between the board's conductive surface 25 and segment 27. In the event that contact 10 is to electrically engage a conductive surface on another electrical contact, blade 31 is formed so that only edge 33 slidably engages this conductive surface prior to electrical contact between noble segment 27 and said surface.

Contact 10 is shown in FIGS. 1 and 2 as including two blade members 31. Additionally, contact 10 includes two noble metal segments 27. It is understood, however, that in the broader aspects of the invention only one blade member is required. The embodiment wherein only one blade is utilized will be defined with the following description of FIGS. 8 and 9. It is further understood with regard to the invention that at least one blade 31 is required for each segment 27 utilized. The primary advantage of using two segments 27 is to further increase the operational capabilities of the contact by providing a means whereby a singular contact can electrically engage two designated conductive surfaces.

Figure 3:
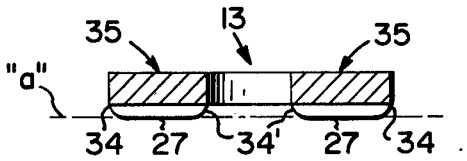
FIG. 3 is a sectional view as taken along the line 3—3 in FIG. 2.

FIG. 3 represents a sectional view of the segment retaining portions 35 of arm 13 as taken along the line 3—3 in FIG. 2. Each portion 35 includes one of the described noble metal segments 27 thereon. Line *a* represents the corresponding plane of contact of segments 27 as these members engage the designated conductive surfaces. Accordingly, it is understood that line *a* further represents the plane of the printed circuit board 23 when contact 10 is utilized in the connector 14 shown in FIG. 10 and 11.

Figure 4:
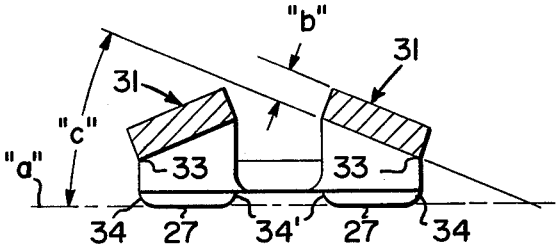
FIG. 4 is a sectional view representing one form of positioning relationship between the blades and plane of contact of the noble metal segments of the invention, said view taken along the line 4—4 in FIG. 2.

FIG. 4 represents the angular displacement (angle *c*) between each of the blades 31 and the plane of contact represented by line *a*. It is further shown in FIG. 4 that the cross-sectional configuration for each blade 31 is of substantially uniform thickness (represented as dimension *b*). This is also a preferred requirement for all blade members of the invention. It is further preferred in the embodiment shown in FIGS. 1–4 that the cross-sectional configuration for each blade 31 be substantially rectangular. Edges 33 are also shown. In the embodiment illustrated in FIG. 4, the preferred angular displacement (depicted by angle *c*) for each of the blades 31 is within the range of from about 10° to about 30°.

Figure 5:
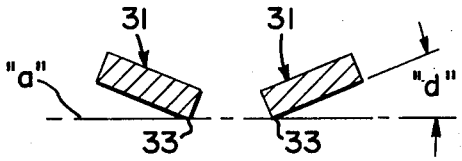
FIGS. 5–9 represent alternate forms of positioning relationships between the blade (s) and noble metal segment (s) of the invention.

FIG. 5 represents an alternate embodiment for contact 10 wherein each of the blades 31 are inwardly angled relative to the plane of contact *a*. Edges 33 are also shown. The preferred angular displacement for blades 31, represented as angle *d*, is substantially the same for that of angle *c* in FIG. 4.

It is understood with regard to the present invention that edges 33 are positioned in such a manner on arm 13 that each are offset from the respective segments 27 relative to the direction of sliding movement between the corresponding conductive surfaces and arm 13. This direction is indicated by the arrows "X" in FIGS. 2 and 10. Accordingly, the portions of the conductive or remaining non-conductive board surfaces which are sllidably engaged by edges 33 are not subsequently engaged by segments 27. This positioning relationship prohibits edges 33 from deforming the portions of the conductive surfaces which subsequently electrically engage noble segments 27. In the event that segments 27 and these surfaces are of substantially similar width, edges 33 will thus only engage the substrate or base member upon which said surfaces are located. The above positioning relationships between edges 33 and segments 27 represent another desirable feature of the invention.

Figure 6:
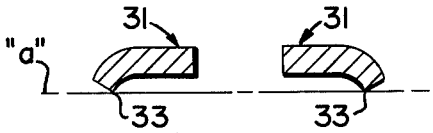
Figure 7:
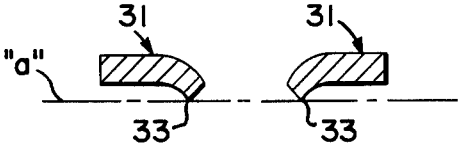

In the embodiments illustrated in FIGS. 6 and 7, the uniformly thick cross-sectional configurations for blades 31 are shown as being of substantially arcuate shape. The arcuate configurations in FIG. 6 are formed so that edges 33 are aligned with the outermost edges 34 of noble metal segments 27 on angular arm 13, said alignment similar to that for edges 33 in FIG. 2. Conversely, the arcuate configurations in FIG. 7 are formed so that edges 33 align with the corresponding inner edges 34' of segments 27. It is understood that in each of the above two embodiments (FIGS. 6 and 7), edges 33 are positioned offset from segments 27 in much the same manner as the embodiments shown in FIGS. 1–5.

Figure 8:
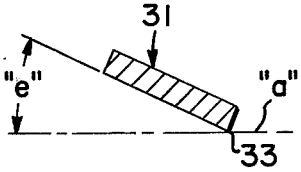

FIG. 8 represents still another embodiment of the invention wherein a singular blade 31 having a uniformly thick cross-sectional configuration is shown. As previously described, contact 10 requires only one blade 31 when employing a corresponding singular noble segment 27. Blade 31 shown in FIG. 8 as positioned at an angle *e* with respect to the contact plane *a*. Angle *e* is preferably similar to that of previous angle *c*.

Figure 9:
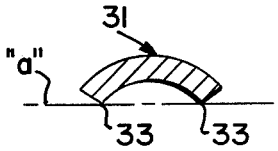

FIG. 9 represents another example of a singular blade embodiment wherein the uniformly thick cross-sectional configuration for blade 31 is substantially arcuate relative to the plane of contact *a*. This embodiment differs somewhat from the singular blade embodiment of FIG. 8, however, in that blade 31 in FIG. 9 presents two edge portions 33 for engaging the corresponding surfaces.

It is understood with regard to the above-defined embodiments that at no time do the remaining surfaces or edges of blades 31 engage the designated conductive surfaces. Only edges 33 on the contact's arm 13 slidably engage the conductive or non-conductive surfaces of the printed circuit board prior to electrical engagement between the conductive surfaces and the contact's noble metal segment or segments.

Figure 11:
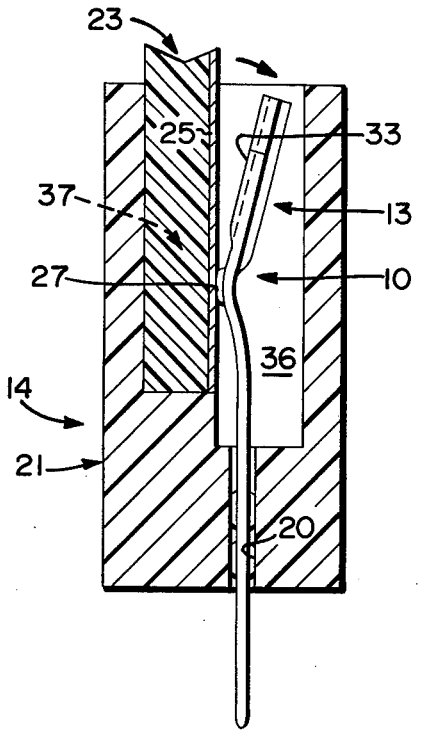

As previously stated, a preferred usage for contact 10 is within a printed circuit board connector 14 shown in FIGS. 10 and 11. Connector 14 includes a recessed area 36 therein for housing arm 13 and a slot 37 for receiving board 23. The conductive surface 25 on board 23 or the non-conductive portion of the board first engage edge 33 of contact 10 during initial board insertion. Thereafter, surface 25 encounters and becomes electrically engaged to noble metal segment 27. This final positioning relationship is shown in FIG. 11.

There has thus been shown and described an electrical contact which prevents material transfer from the contact's arm onto a noble metal segment located on the arm. This material transfer prevention is accomplished in a more expeditious manner than on electrical contacts of the known prior art. There has also been shown and described a printed circuit board connector, said connector ideally suited for incorporating the above-desribed electrical contact therein.

While there has been shown and described what are at present considered the preferred embodiments of the invention, it will be obvious to those skilled in the art that various changes and modifications may be made therein without departing from the scope of the invention as defined by the appended claims.

What is claimed is:

1. In an electrical contact including an angular engagement arm for slidably engaging a conductive surface wherein said angular engagement arm includes a noble metal segment thereon for electrically contacting said conductive surface and means for preventing transfer of material from said arm onto said noble metal segment, the improvement wherein said material transfer prevention means comprises:

at least one elongated blade adjoining said noble metal segment and including at least one edge thereon wherein said edge is offset on said angular engagement arm from said noble metal segment relative to the direction of movement of said conductive surface during said sliding engagement by said arm, said blade having a cross-sectional configuration of substantially uniform thickness and formed so that only said edge slidably engages said conductive surface prior to said electrical contact between said surface and said noble metal segment.

2. The improvement according to claim 1 wherein said cross-sectional configuration of said blade is substantially rectangular.

3. The improvement according to claim 1 wherein said cross-sectional configuration of said blade is substantially arcuate.

4. The improvement according to claim 2 wherein said substantially rectangular cross-sectional configuration forms an established angle with the plane of contact of said noble metal segment.

5. The improvement according to clam 4 wherein said established angle is within the range of from about 10° to about 30°.

6. In a printed circuit board connector having an insulative housing and at least one electrical contact including an angular engagement arm positioned within said housing for slidably engaging a printed circuit board and wherein said angular engagement arm includes a noble metal segment thereon for electrically contacting a conductive surface on said board and means for preventing transfer of material from said arm onto said noble metal segment, the improvement wherein said material transfer prevention means comprises:

at least one elongated blade adjoining said noble metal segment and including at least one edge thereon wherein said edge is offset on said angular engagement arm from said noble metal segment relative to the direction of movement of said printed circuit board during said sliding engagement by said arm, said blade having a cross-sectional configuration of substantially uniform thickness and formed so that only said edge slidably engages said printed circuit board prior to said electrical contact between said conductive surface on said board and said noble metal segment.

7. The improvement according to claim 6 wherein said cross-sectional configuration of said blade is substantially rectangular.

8. The improvement according to claim 6 wherein said cross-sectional configuration of said blade is substantially arcuate.

9. The improvement according to claim 7 wherein said substantially rectangular cross-sectional configuration forms an established angle with the plane of contact of said noble metal segment.

10. The improvement according to claim 9 wherein said established angle is within the range of from about 10° to about 30°.

* * * * *